US008067759B1

(12) United States Patent
Swartz et al.

(10) Patent No.: US 8,067,759 B1
(45) Date of Patent: Nov. 29, 2011

(54) RADIATION PROTECTIVE VEST

(75) Inventors: Dennis Francis Swartz, Newport News, VA (US); Nicholas J. Napoda, Newport News, VA (US)

(73) Assignee: Burlington Medical Supplies, Inc., Newport News, VA (US)

( * ) Notice: Subject to any disclaimer, the term of this patent is extended or adjusted under 35 U.S.C. 154(b) by 115 days.

(21) Appl. No.: 12/658,799

(22) Filed: Feb. 16, 2010

(51) Int. Cl.
*G21F 3/02* (2006.01)
*G21F 3/025* (2006.01)
*A41D 1/04* (2006.01)

(52) U.S. Cl. ..... 250/516.1; 250/519.1; 250/515.1; 2/102; 2/108; 2/92

(58) Field of Classification Search ..... 250/516.1, 250/519.1, 515.1; 2/102, 108, 92
See application file for complete search history.

(56) References Cited

U.S. PATENT DOCUMENTS 3,394,260 A * 7/1968 Phipps ..... 250/516.1
5,028,796 A * 7/1991 Swartz ..... 250/516.1
5,274,851 A * 1/1994 Simpkins et al. ..... 2/102
7,608,847 B2 * 10/2009 Rees ..... 250/516.1

* cited by examiner

*Primary Examiner* — Nikita Wells
(74) *Attorney, Agent, or Firm* — Herbert L. Bello

(57) ABSTRACT

A radiation protective vest includes a back panel with flaps at opposite lower sides and a pair of front panels, each panel containing radiation shielding material. Each front panel has an inner straight edge and a flap at a lower outer side. The front and back panels are connected to form the vest. A first strap is attached to one front panel and a second strap is attached to the other front panel. The second strap is threaded in a first sleeve attached to the inside of the back panel and the first strap is threaded in a second sleeve attached to the inside of the back panel. A fastener is provided on the free ends straps. When the vest is worn, the flaps of the front panels press against a user's waist and the back panel flaps overlap the front panels.

16 Claims, 4 Drawing Sheets

RADIATION PROTECTIVE VEST

BACKGROUND OF THE INVENTION

1. Field of Invention

The present invention relates to radiation protective garments and, more particularly, to a radiation protective vest with overlapping panels for sizing adjustability and straps for weight distribution of weight from the shoulders to the waist and lower back.

2. Description of the Prior Art

Radiation protective garments for use by technicians and others exposed to radiation are known. Typically, radiation protective garments are cumbersome and provide limited weight distribution from the shoulders to waist of a user. Due to the amount of lead utilized in prior art radiation protective garments, such garments are relatively heavy, difficult to put on and uncomfortable to wear. U.S. Pat. No. 5,274,851 shows a radiation protective garment having a wide resilient support member that is attached to the back panel of the garment. Two front panels that are secured to the back panel are secured to one another by means of a full zipper. In this type of radiation protective garment, the use cannot control the transfer of weight from the shoulders to the back. Furthermore, such a garment has limited adjustability for sizing on the sides under the arms of the user and somewhat difficult to put on. U.S. Pat. No. 4,441,025 discloses a radiation protective garment with a full front panel and shoulder straps that crisscross at the user's back and transfer some of the weight from the user's shoulders. However, a significant portion of the weight of the garment is carried by the user's shoulders. A need has arisen for a radiation protective garment in the form of a radiation protective vest that can be easily put on by the user, is relatively light weight and provides a wide range of sizing adjustability.

SUMMARY OF THE INVENTION

It is an object of the present invention to provide a radiation protective garment, particularly, a radiation protective vest, that does not suffer from the limitations and disadvantages of prior art upper body radiation protective garments. The radiation protective vest embodying the present invention includes a back panel with flaps at opposite lower sides and a pair of front panels, each panel containing radiation shielding material within a durable fabric covering, such as a nylon material. Each front panel has an inner straight edge and a flap at a lower outer side. One front panel is connected to an upper left portion of the back panel and the other front panel is connected to an upper right portion of the back panel to form a vest. The back panel and front panels are cutout so as to form a neck opening and arm openings when the back panel and front panels are attached to one another. A first elastomeric strap is attached to the backside of one front panel and a second elastomeric strap is attached to the backside of the other front panel below the first strap. A first sleeve for the second strap is attached to the inside of the back panel at one side thereof and a second sleeve for the first strap is attached to the inside of the back panel at an opposite side thereof. Attachment means, for example, a loop and hook Velcro fastener, is provided on opposite sides of the straps so that a user can adjust the tension on the straps for securing the vest and transferring the weight from the shoulders to the lower back. When the vest is worn, the flaps of the front panels press against a user's waist and the back panel flaps overlap the front panels. The radiation protection vest embodying the present invention is easy to put on and take off, and accommodates a relatively wide range of user sizes and body types due its side stability. The front flaps pressing against the user's waist transfers a portion of the weight of the vest from the user's shoulders to the user's waist and lower back. The overlapping back flaps provide increased radiation protection. Other objects of the present invention will in part be obvious and will in part appear hereinafter.

The invention accordingly comprises the garment, together with its parts, elements and interrelationships that are exemplified in the following disclosure, the scope of which will be indicated in the appended claims.

BRIEF DESCRIPTION OF THE DRAWINGS

A fuller understanding of the nature and objects of the present invention will become apparent upon consideration of the following detailed description taken in connection with the accompanying drawings, wherein.

DETAILED DESCRIPTION OF THE PREFERRED EMBODIMENTS

Figure 1:
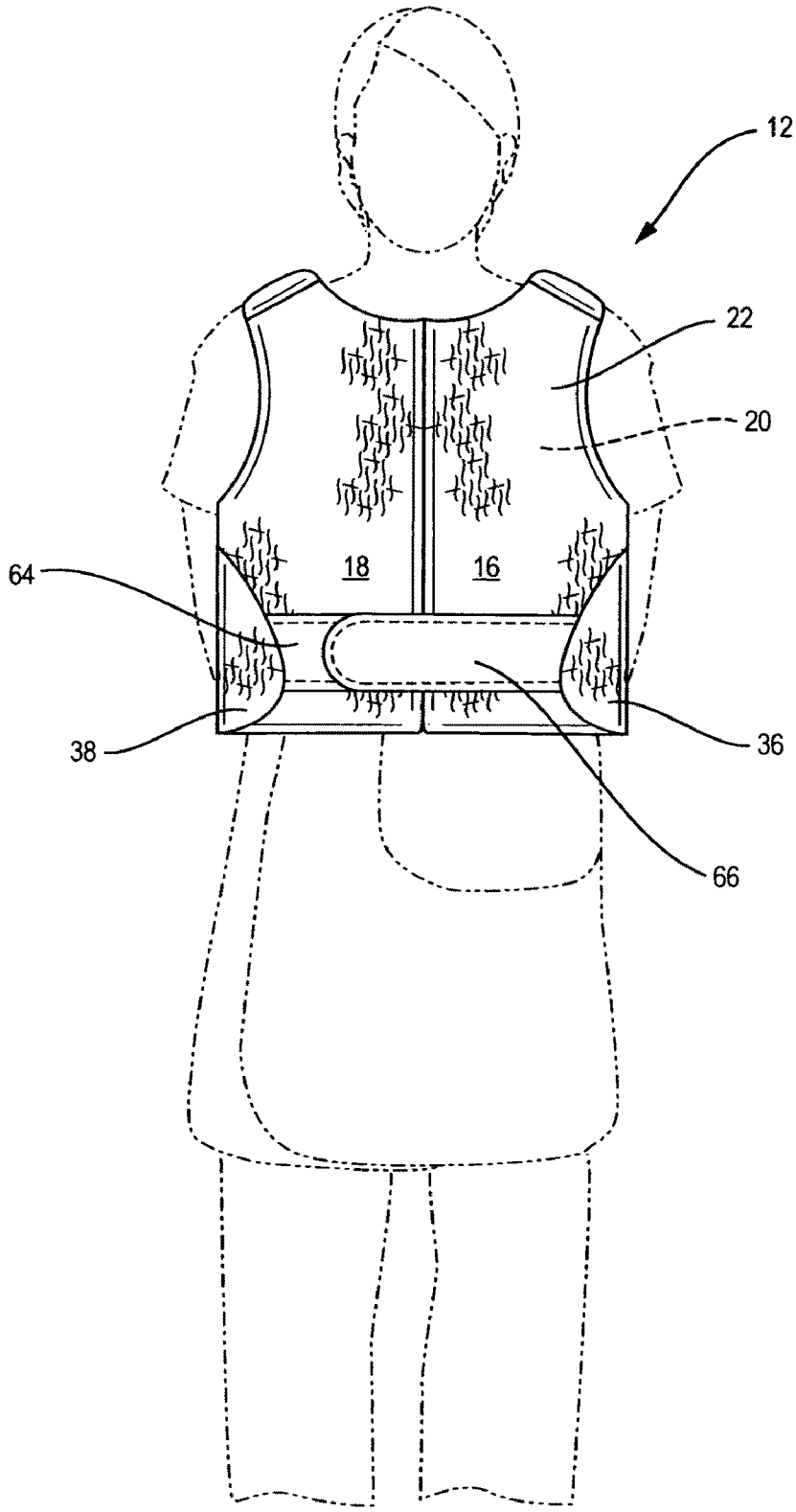
FIG. 1 is a perspective view of a radiation protective vest made in accordance with the invention being worn by a user.
Figure 2:
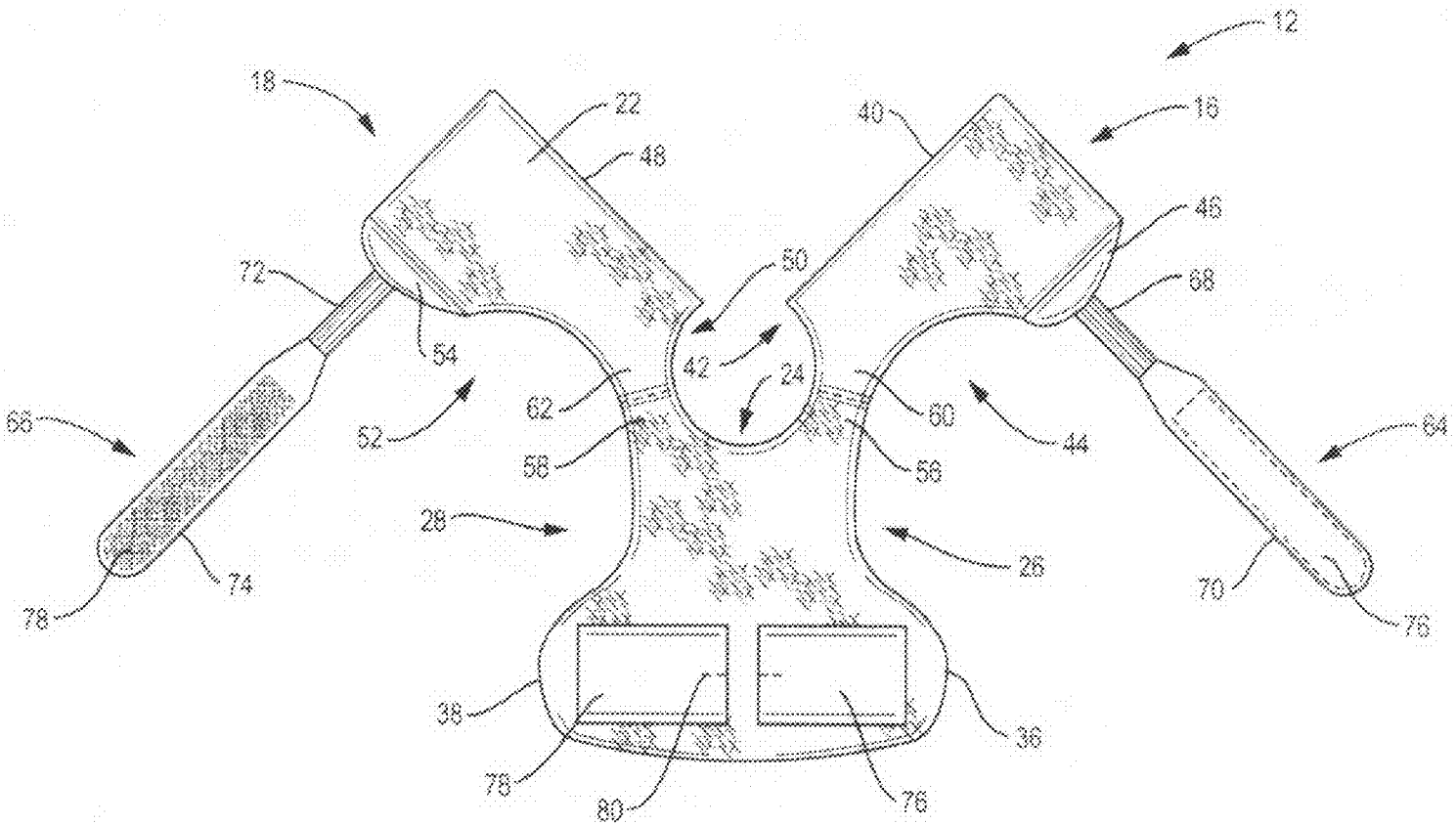
FIG. 2 is a plan view of a radiation protective vest of FIG. 1, the vest lying flat and showing the inside of the back panel, attached front panels, elastomeric straps and sleeves made in accordance with the invention.

Referring now to the drawings, particularly FIGS. 1 and 2, there is shown a radiation protective garment 12 embodying the present invention worn by a user. In the illustrated embodiment, radiation protective garment 12 is a vest having a substantially rectangular back panel 14, a substantially rectangular a left front panel 16 and a substantially rectangular right front panel 18. Each panel 14, 16, 18 contains radiation shielding material 20 within a durable covering 22, for example, a nylon material.

Figure 3:
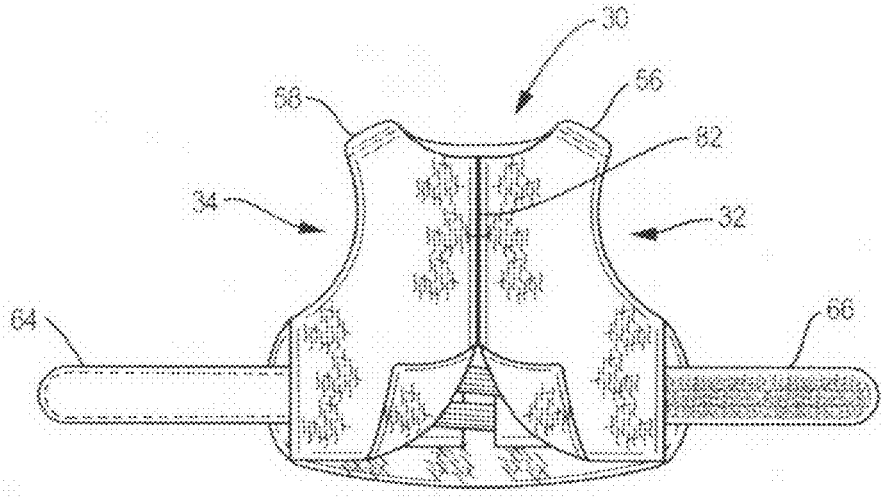
FIG. 3 is a front view of the vest of FIG. 1 with the front panels folded in front of the back panel, the front panels being open.
Figure 4:
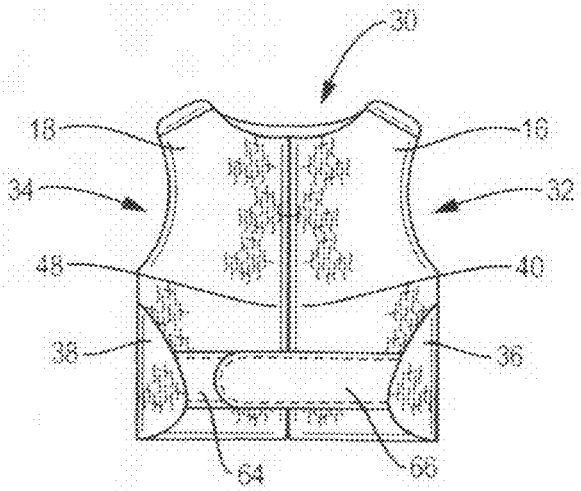
FIG. 4 is a front view of the vest of FIG. 1 with the front panels folded in front of the back panel, the front panels being closed.

As shown in FIGS. 2, 3 and 4, back panel 14 has an arcuate cutout 24 at its top margin and arcuate cutouts 26,28 at opposite upper side margins. Arcuate cutout 24 forms a portion of a neck opening 30 of vest 12 and arcuate cutouts 26,28 form portions of a left arm opening 32 and a right arm opening 34, respectively. Elongated flaps 36 and 38 are formed at opposite lower side margins of back panel 14.

Left front panel 16 has a substantially straight inner side 40. Left front panel 16 has an arcuate cutout 42 at its top margin and an arcuate cutout 44 at its upper outer side margin. Arcuate cutouts 26 and 44 form left arm opening 32. A substantially semicircular flap 46 is provided at a lower left outer side margin of left front panel 16.

Right front panel 18 has a substantially straight inner side 48. Right front panel 18 has an arcuate cutout 50 at its top margin of and an arcuate cutout 52 at its upper outer side margin. Arcuate cutouts 24,42 and 50 form neck opening 30. A substantially semicircular flap 54 is provided at a lower left outer side margin of left front panel 18.

A left shoulder portion 56 and a right shoulder portion 58 are formed in back panel 14 adjacent neck opening 30. A left shoulder portion 60 is formed in left front panel 16 adjacent neck opening 30 and a right shoulder portion 62 is formed in right front panel 18 adjacent the neck opening. Left shoulder portion 60 of left front panel 16 is connected to left shoulder portion 56 of back panel 14 and right shoulder portion 62 of right front panel 18 is connected to right shoulder portion 58 of the back panel.

A left strap 64 is attached to left front panel 16 at its lower outside margin and a right strap 66 is attached to right front panel 18 at its lower outside margin. Left strap 64 includes a narrow elastomeric portion 68 and a wide band portion 70. One end of narrow elastomeric portion 68 is attached to one end of wide band portion 70. A free end of narrow elastomeric portion 68 is attached to left front panel 16 at flap 46. Right strap 66 includes a narrow elastomeric portion 72 and a wide band portion 74. One end of narrow elastomeric portion 72 is attached to one end of wide band portion 74. A free end of narrow elastomeric portion 72 is attached to right front panel 18 at flap 54. A first attachment means 76 is attached to the free end of wide band portion 70 and a second attachment means 78 is attached to the free end of wide band portion 74. In the illustrated embodiment, first and second attachment means 76,78 are cooperating loop and hook fasteners that are positioned on opposite faces of wide band portions 70,74 for securing left and right straps 64,66 together at various positions when vest 12 is worn by the user.

As shown in FIGS. 2 and 3, a sleeve 76 is attached to an inside face of back panel 14 at its lower left side and a sleeve 78 is attached to an inside face of the back panel at its lower right side. Sleeves 76 and 78 are laterally disposed relative to one another on the inside face of back panel 14. Sleeve 76 is configured to receive strap 66 and sleeve 78 is configured to receive strap 64. Separating means 80, for example, stitches, is provided for keeping straps 66 and 64 apart when they are threaded into sleeves 76 and 78, respectively. Also, stitches 80 keep narrow elastomeric portions 68 and 72 in sleeves 78 and 76, respectively. Sleeves 76 and 78 are positioned at the waist of the user when vest 12 is being worn by the user. As shown in FIGS. 3 and 4, a securing means 82, for example a zipper, on inner straight sides 40,48 of left and right front panels 16,18, respectively, is provided for securing the left front panel to the right front panel.

When a user puts on vest 12 and simultaneously pulls on straps 64 and 66, left front panel 16 and right front panel 18 are pulled rearwardly toward one another and toward back panel 14 while pulling back panel 14 forward toward the front of the user. Simultaneously, flaps 46 and 54 are pressed against the waist of the user and flaps 36 and 38 overlap left and right front panels 16,18. Overlapping of back panel 14, left front panel 16 and right front panel 18 provide increased radiation protection. When straps 64 and 66 are pulled, flaps 46 and 54 exert a force on the user's waist for transferring a portion of the weight of vest 12 from the user's shoulders to the user's waist and lower back. Straps 64 and 66 are secured to one another by attachment means 76,78.

Figure 5:
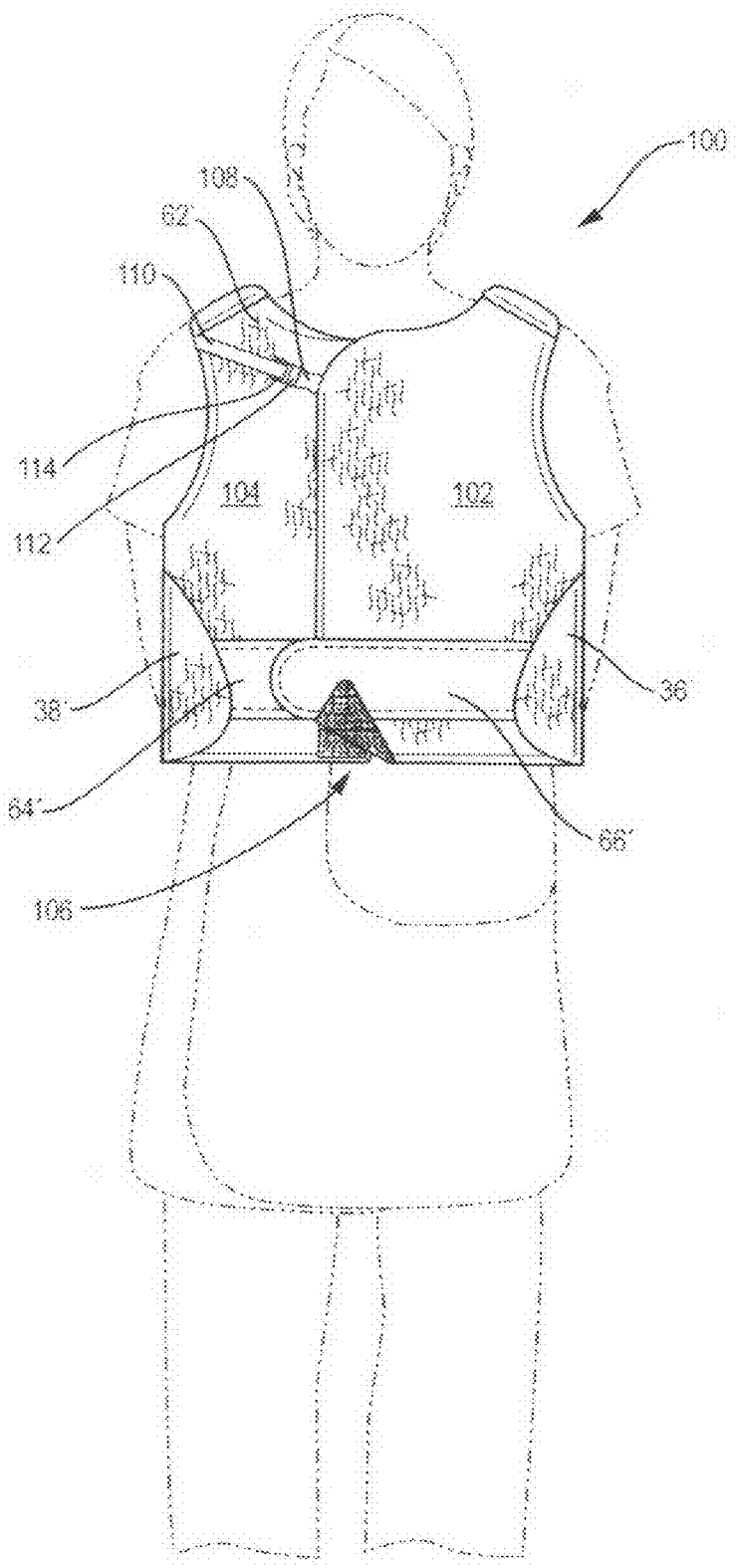
FIG. 5 is a perspective view of an alternate embodiment of the radiation protective vest made in accordance with the invention being worn by a user.

Referring now to FIG. 5, there is shown a vest 100 which is an alternative embodiment of the invention. Vest 100 is similar to vest 12, accordingly, corresponding parts will be identified with like reference characters and distinguished by a prime notation. Vest 100 includes a left front panel 102 and a right front panel 104. Securing means 82 of vest 12 is replace with a hook and loop securing means 106 on the inside and outside of the inner edges of the left front panel 102 and right front panel 104. When vest 100 is secured by the user, left front panel 102 overlaps right front panel 104, the front panels being held in place by hook and loop securing means 106. A strap 108 is attached at the upper margin of left front panel 102 and a strap 110 is attached to right front panel 104 adjacent right shoulder portion 62'. Mating buckle components 112 and 114 are provided on the free ends of straps 108 and 110, respectively. When vest 100 is secure by the user, mating buckle components 112 and 114 are secured to one another for keeping neck opening closed. Vest 100 is put on by the user in the manner hereinbefore described for vest 12. The tightening of straps 64' and 66', the overlapping of flaps 36',38' and the transferring of a portion of the weight of vest 100 from the user's shoulders to the user's waist and lower back is the same as described for vest 12.

Since certain changes may be made in the foregoing disclosure without departing from the scope of the invention herein involved, it is intended that all matter contained in the above description and depicted in the accompanying drawings be construed in an illustrative and not in a limiting sense.

What is claimed is:

1. A radiation protective vest for protecting a user's upper body, said vest having radiation shielding material therein, said vest having left and right arm cutouts and a neck cutout, said vest comprising:

(a) a back panel having an arcuate cutout at a top side and arcuate cutouts at opposite upper margins, flaps at opposite lower sides of said back panel;

(b) first and second front panels, each said front panel having an arcuate cutout at a top side, said top side arcuate cutouts of said back panel and said arcuate cutouts of said first and second front panels forming said neck cutout, left and right shoulder portions formed in said back panel, said first front panel and said second panel at said neck cutout, said left and right shoulder portions of said back panel connected respectively to said right and left shoulder portions of said first and second front panels, each said first and second front panel having a straight inner side, an arcuate cutout formed at upper outer margins of each of said first and second front panels, said arcuate cutouts at said upper margins of said back panel and said arcuate cutouts at said upper margins of said first and second front panels forming said left and right arm cutouts when said vest is worn by a user, a flap at a lower outer side of each said first and second front panel;

(c) securing means on said straight inner sides of said first and second front panels for securing said first front panel and said second front panel together;

(d) a first strap attached to said lower side of said first panel and a second strap attached to said lower side of said second front panel;

(e) first and second sleeves, said first sleeve attached to an inside face of said back panel adjacent one side of said lower side of said back panel, said second sleeve attached to said inside face of said back panel adjacent an opposite side of said lower side of said back panel, said first and second sleeves being laterally aligned, said first sleeve configured to receive said second strap, said second sleeve configured to receive said first strap, said first and second sleeves positioned at the waist of the user when said vest is being worn by the user, said first strap threaded into said second sleeve, said second strap threaded into said first strap, said first and second straps held away from one another when threaded into said second and first sleeves, respectively; and (f) first and second attachment means, said first attachment means attached to said first strap at a free marginal end thereof and said second attachment means attached to said second strap a free marginal end thereof, said first and second attachment means attachable to one another at various positions, when a user puts on said vest and simultaneously pulls on said first strap and said second strap, said first and second front panels are pulled rearwardly toward one another and toward said back panel while pulling said back panel forward toward the front of the user, said flaps of said first and second front panels pulled against the waist of the user and one of said flaps of said back panel overlapping one of said first and second front panels and the other of said flaps of said back panel overlapping the other of said first and second front panels, said overlapping of said back panel, said first front panel, said second front panel providing increased radiation protection, pulling of said first and second straps exerting a force on the user's waist for transferring a portion of the weight of the vest from the user's shoulders to the user's waist and lower back, said first and second straps attached to one another by said first and second attachment means.

2. The radiation protective vest as claimed in claim 1 wherein said first strap includes a narrow elastomeric portion and a wide band portion, one end of said narrow elastomeric portion of said first strap attached to one end of said wide band portion of said first strap, a free end of said narrow elastomeric portion of said first strap attached to said first front panel, said first attachment means attached to the free end of said wide band portion of said first strap, and said second strap includes a narrow elastomeric portion and a wide band portion, one end of said narrow elastomeric portion of said second strap attached to one end of said wide band portion of said second strap, a free end of said narrow elastomeric portion of said second strap attached to said second front panel, said second attachment means attached to the free end of said wide band portion of said second strap.

3. The radiation protective vest as claimed in claim 1 wherein said securing means is a hook and loop fastening means, said hook fastening means secured to one of said first and second front panels and said loop fastening means secured to the other of said first and second front panels, said first and second front panels secured in overlapping relationship by said hook and loop fastening means.

4. The radiation protective vest as claimed in claim 3 including a first neck closing fastener on one of said first and second front panels and a second neck closing fastener on the other of said first and second front panels adjacent said shoulder portion of said other of said first and second front panels for securely closing said vest about the user's neck.

5. The radiation protective vest as claimed in claim 4 wherein said first and second neck closing fasteners are mating buckles.

6. The radiation protective vest as claimed in claim 1 wherein said securing means is a zipper.

7. A radiation protective vest for protecting a user's upper body, said vest having radiation shielding material therein, said vest having left and right arm cutouts and a neck cutout, said vest comprising:

(a) a substantially rectangular back panel, a first arcuate cutout section at a top margin of said back panel forming a portion of said neck cutout, second and third arcuate cutout sections at opposite upper side margins of said back panel forming portions of said left and right arm cutouts, a flap being formed at opposite lower side margins of said back panel;

(b) a substantially rectangular left front panel having a substantially straight inner side, a fourth arcuate cutout section at a top margin of said left front panel, a fifth arcuate cutout section at an upper outer side margin of said left front panel, said second and fifth arcuate cutout sections forming said left arm cutout, a substantially semicircular flap at a lower left outer side margin of said left front panel;

(c) a substantially rectangular right front panel having a substantially straight inner side, a sixth arcuate cutout section at a top margin of said right front panel, said first, fourth and sixth arcuate cutout sections forming said neck cutout, right and left shoulder portions formed in said back panel adjacent said neck cutout, a left shoulder portion formed in said left front panel adjacent said neck cutout and a right shoulder portion formed in said right front panel adjacent said neck cutout, said shoulder portion of said left front panel connected to said left shoulder portion of said back panel and said shoulder portion of said right front panel connected to said right shoulder portion of said back panel, seventh arcuate cutout section at an upper outer side margin of said right front panel, said third and seventh arcuate cutout sections forming said right arm cutout, a substantially semicircular flap at a lower right outer side margin of said right front panel;

(d) securing means on said inner straight sides of said left and right front panels for securing said left front panel to said right front panel;

(e) a first strap attached to said left front panel at said lower outside margin;

(f) a second strap attached to said right front panel at said lower outside margin;

(g) first and second sleeves, said first sleeve attached to an inside face of said back panel at a lower left side, said first sleeve configured to receive said second strap, said second sleeve attached to said inside face of said back panel at a lower right side, said first and second sleeves being laterally disposed relative to one another, said second sleeve configured to receive said first strap, said first and second sleeves positioned at the waist of the user when said vest is being worn by the user, said first strap threaded into said second sleeve, said second strap threaded into said first sleeve, said first and second straps held away from one another when threaded into said second and first sleeves, respectively; and (h) first and second attachment means, said first attachment means attached to said first strap at a free marginal end thereof and said second attachment means attached to said second strap at a free marginal end thereof, said first and second attachment means configured to hold said first strap to said second straps at various positions, when a user puts on said vest and simultaneously pulls on said first strap and said second strap, said left and right front panels are pulled rearwardly toward one another and toward said back panel while pulling said back panel forward toward the front of the user, said flaps of said left and right front panels pulled against the waist of the user and one of said flaps of said back panel overlapping one of said left and right front panels and the other of said flaps of said back panel overlapping the other of said left and right front panels, said overlapping of said back panel, said left front panel, said right front panel providing increased radiation protection, pulling of said first and second straps exerting a force on the user's waist for transferring a portion of the weight of the vest from the user's shoulders to the user's waist and lower back, said first and second straps attached to one another by said first and second attachment means.

8. The radiation protective vest as claimed in claim 7 wherein said first strap includes a narrow elastomeric portion and a wide band portion, one end of said narrow elastomeric portion of said first strap attached to one end of said wide band portion of said first strap, a free end of said narrow elastomeric portion of said first strap attached to said left front panel, said first attachment means attached to the free end of said wide band portion of said first strap, and said second strap includes a narrow elastomeric portion and a wide band portion, one end of said narrow elastomeric portion of said second strap attached to one end of said wide portion of said second strap, a free end of said narrow elastomeric portion of said second strap attached to said right front panel, said second attachment means attached to the free end of said wide band portion of said second strap.

9. The radiation protective vest as claimed in claim 7 wherein said securing means is a hook and loop fastening means, said hook fastening means secured to one of said left and right front panels and said loop fastening means secured to the other of said left and right front panels.

10. The radiation protective vest as claimed in claim 9 including a first neck closing fastener on one of said left adjacent said neck cutout and on right front panels adjacent said shoulder portion for securely closing said vest about the user's neck.

11. The radiation protective vest as claimed in claim 10 wherein said first and second neck closing fasteners are mating buckles.

12. The radiation protective vest as claimed in claim 7 wherein said securing means is a zipper.

13. A radiation protective vest for protecting a user's upper body, said vest having radiation shielding material therein, said vest having left and right arm cutouts and a neck cutout, said vest comprising:

(a) a back panel having an arcuate cutout at a top side, arcuate cutouts at opposite upper margins and flaps at opposite lower sides;

(b) first and second front panels, each said first and second front panel having a straight inner side and a flap at a lower outer side, an arcuate cutout formed at upper outer margins of each said first and second front panel, each said first and second front panel having an arcuate cutout at a top side, said top side arcuate cutouts of said back panel and said arcuate cutouts of said first and second front panels forming said neck cutout, left and right shoulder portions formed in said back panel, said first front panel and said second panel adjacent said neck cutout, said left and right shoulder portions of said back panel connected respectively to said left and right shoulder portions of said first and second front panels, said arcuate cutouts at said upper margins of said back panel and said arcuate cutouts at said upper margins of said first and second front panels forming said left and right arm cutouts when said vest is worn by a user;

(c) hook and loop securing means on said inner straight sides of said first and second front panels, said hook and loop securing means configured to secure said first front panel and said second front panel to one another in an overlapping relationship;

(d) a first strap attached to said lower side of said first panel and a second strap attached to said lower side of said second front panel;

(e) first and second sleeves, said first sleeve attached to an inside face of said back panel at one side of said lower side of said back panel, said second sleeve attached to an opposite side of said lower side back panel, said first and second sleeves being laterally aligned, said first sleeve configured to receive said second strap, said second sleeve configured to receive said first strap, said first and second sleeves positioned at the waist of the user when said vest is being worn by the user, said first strap threaded into said second sleeve, said second strap threaded into said first strap, said first and second straps held away from one another when threaded into said second and first sleeves, respectively; and (f) first and second attachment means, said first attachment means attached to said first strap at a free marginal end thereof and said second attachment means attached to said second strap a free marginal end thereof, said first and second attachment means attachable to one another at various positions to permit the user to pull said first strap further into said second sleeve and said second strap further into said first sleeve for simultaneously pulling said first and second front panels in opposite directions toward one another and toward said back panel while pulling said back panel towards the front of the user, said flaps of said first and second front panels pulled against the waist of the user and one of said flaps of said back panel overlapping said first front panel and the other of said flaps of said back panel overlapping said second front panel, said overlapping of said back panel, said first front panel, said second front panel providing increased radiation protection, pulling of said first and second straps exerting a force on the user's waist for transferring a portion of the weight of the vest from the user's shoulders to the user's waist and lower back.

14. The radiation protective vest as claimed in claim 13 including a first neck closing fastener on one of said first and second front panels adjacent said neck cutout and the other said first and second front panels adjacent said shoulder portion for securely closing said vest about the user's neck.

15. The radiation protective vest as claimed in claim 14 wherein said first and second neck closing fasteners are mating buckles.

16. The radiation protective vest as claimed in claim 13 wherein said first strap includes a narrow elastomeric portion and a wide band portion, one end of said narrow elastomeric portion of said first strap attached to one end of said wide band portion of said first strap, a free end of said narrow elastomeric portion of said first strap attached to said first front panel, said first attachment means attached to the free end of said wide band portion of said first strap, and said second strap includes a narrow elastomeric portion and a wide band portion, one end of said narrow elastomeric portion of said second strap attached to one end of said wide band portion of said second strap, a free end of said narrow elastomeric portion of said second strap attached to said second front panel, said second attachment means attached to the free end of said wide band portion of said second strap.

* * * * *